US012365503B2

(12) United States Patent
Shih et al.

(10) Patent No.: US 12,365,503 B2
(45) Date of Patent: Jul. 22, 2025

(54) COTTON STUFFING MACHINE

(71) Applicant: CVC TECHNOLOGIES INC., Taichung (TW)

(72) Inventors: Chi-Huan Shih, Taichung (TW); Chang-Cheng Chen, Taichung (TW); Yung-Sheng Liu, Taichung (TW)

(73) Assignee: CVC TECHNOLOGIES INC., Taichung (TW)

( * ) Notice: Subject to any disclaimer, the term of this patent is extended or adjusted under 35 U.S.C. 154(b) by 89 days.

(21) Appl. No.: 18/374,001

(22) Filed: Sep. 28, 2023

(65) Prior Publication Data

US 2025/0108951 A1 Apr. 3, 2025

(51) Int. Cl.
*B65B 61/22* (2006.01)
*B65H 20/02* (2006.01)

(52) U.S. Cl.
CPC ..... *B65B 61/22* (2013.01); *B65H 20/02* (2013.01); *B65H 2511/224* (2013.01)

(58) Field of Classification Search
CPC .... B65B 61/22; B65H 2511/224; B65H 29/12
USPC ..... 53/115; 221/43
See application file for complete search history.

(56) References Cited

U.S. PATENT DOCUMENTS 2,171,572 A * 9/1939 Kelly ..... B65B 61/22 53/115
2,269,722 A * 1/1942 Lakso ..... B65B 61/22 53/115
2,412,089 A * 12/1946 Kelly ..... B65B 61/22 53/115
2,501,770 A * 3/1950 Gantzer ..... B65B 61/22 53/115
2,596,813 A * 5/1952 Gantzer ..... B65B 61/22 53/115
2,607,712 A * 8/1952 Sturken ..... D21H 23/48 264/129
2,621,372 A * 12/1952 Wilkie ..... D01H 5/22 19/294
2,691,473 A * 10/1954 Gantzer ..... B65B 61/22 53/115
2,805,531 A * 9/1957 Dimond ..... B65B 61/22 53/115
2,817,934 A * 12/1957 Dimond ..... B65B 61/22 53/115

(Continued)

*Primary Examiner* — Robert F Long
*Assistant Examiner* — Eduardo R Ferrero
(74) *Attorney, Agent, or Firm* — WPAT, PC

(57) ABSTRACT

A cotton stuffing machine includes a roller conveyance device, a rotation device, an upward pushing device, and a downward pressing device. The roller conveyance device inputs cotton and presses and pulls the cotton to deliver a cotton section. The rotation device includes a plurality of rotation arms. Each rotation arm has a holding barrel on two ends thereof, and undergoes a 180-degree rotation displacement between a feeding position and an outputting position. The upward pushing device is disposed beneath the feeding position for pushing the cotton section upward into the holding barrel. The downward pressing device is disposed above the outputting position for pushing out the cotton section and inserting it into the bottle. Thus, the present invention improves the efficiency of stuffing operation for stuffing the cotton into the bottles.

8 Claims, 8 Drawing Sheets

(56) References Cited

U.S. PATENT DOCUMENTS 2,895,273 A * 7/1959 Lakso ..... B65B 61/22 53/529
3,030,748 A * 4/1962 Moses ..... B65B 61/22 53/115
3,910,010 A * 10/1975 Cowley ..... B65B 61/22 53/115
4,523,366 A * 6/1985 Lodge ..... B01L 3/0213 422/922
4,777,779 A * 10/1988 Lodge ..... B65B 61/22 53/115
4,890,753 A * 1/1990 Duryee ..... B65B 61/22 53/472
5,218,850 A * 6/1993 Davi ..... B21D 5/14 72/241.4
5,709,066 A * 1/1998 Prochaska ..... B65B 61/20 53/238
5,738,264 A * 4/1998 Jackson ..... B65H 20/02 226/177
6,168,146 B1 * 1/2001 Komuro ..... B65H 9/06 271/10.12
6,378,749 B1 * 4/2002 Robin ..... B65H 20/02 226/177
6,533,154 B2 * 3/2003 Kitai ..... B65H 20/02 226/177
6,598,368 B1 7/2003 Haida
6,684,600 B1 * 2/2004 Yang ..... B65B 1/24 53/436
6,799,412 B2 * 10/2004 Jalbert ..... B65B 61/22 226/62
7,292,796 B2 * 11/2007 Yax ..... G03G 15/2032 399/45
7,731,070 B2 * 6/2010 Meyer ..... B65H 20/02 226/176
2003/0182902 A1 * 10/2003 Chen ..... B65B 61/22 53/115
2003/0205031 A1 * 11/2003 Haida ..... B65B 61/22 53/115
2003/0221394 A1 * 12/2003 Jalbert ..... B65B 61/22 53/115
2005/0056992 A1 * 3/2005 Ono ..... H04N 1/00745 271/272
2005/0239624 A1 * 10/2005 Dannemann ..... B65H 45/12 493/421
2005/0275160 A1 * 12/2005 Reslow ..... B65H 20/02 271/273
2006/0118590 A1 * 6/2006 Fieffer ..... B65H 20/02 226/177
2012/0068398 A1 * 3/2012 Asari ..... B65H 7/02 271/3.2
2014/0243179 A1 * 8/2014 Tomczak ..... B31F 1/0009 493/442

* cited by examiner

COTTON STUFFING MACHINE

BACKGROUND OF THE INVENTION

1. Field of the Invention

The present invention relates to highly efficient cotton stuffing machine.

2. Description of the Related Art

The U.S. Pat. No. 6,598,368 "Cotton holding disk" discloses a machine having a conveyance device for conveying bottles through the machine, wherein the bottles are stuffed with cotton. Therein, the cotton clamping plate comprises a pair of insertion tubes for holding the cotton, and the cotton clamping plate rotates for the insertion tubes to reciprocate between two positions arranged in 180 degrees. When the first bottle is in alignment with one of the insertion tubes, the pusher pushes the cotton into the first bottle, and the other insertion tube is filled with cotton and standing by. Then, the cotton clamping plate rotates for the insertion tube filled with cotton to be in alignment with the second bottle to carry out the stuffing process, and the empty insertion tube rotates back to be filled with cotton, awaiting for the subsequent cotton stuffing process.

However, the patent aforementioned is only able to fill the cotton in one bottle each time, so that the overall operation is less efficient and failing to meet the industrial expectation.

SUMMARY OF THE INVENTION

To improve the issues above, the present invention discloses a cotton stuffing machine capable of simultaneously inputting a plurality of stripe-shaped cotton, wherein the cotton sections are pulled by the roller sets, transported by the rotation device, and pressing downward into the bottle, achieving a highly efficient operation mode.

For achieving the aforementioned objectives, an embodiment of the present invention comprises a cotton stuffing machine, comprising a roller conveyance device, a rotation device, an upward pushing device, and a downward pressing device. The roller conveyance device comprises a plurality of roller sets arranged in parallel. Each roller set comprises two fix rollers and two neighboring movable rollers. The movable roller is adjustable away from or toward the fix roller, whereby a cotton is pressed and pulled to deliver a cotton section through the roller set. The rotation device comprises a plurality of rotation arms corresponding to the roller sets. Each rotation arm comprises a hollow holding barrel on two ends thereof, respectively. The rotation arm undergoes a 180-degree rotation displacement between a feeding position and an outputting position. The upward pushing device is disposed beneath the feeding position and comprises a plurality of pushing members corresponding to the rotation arms for pushing the cotton section upward into the holding barrel. The downward pressing device is disposed above the outputting position and comprises a plurality of stamping members corresponding to the rotation arms. When the holding barrel containing the cotton section rotates from the feeding position to the outputting position to be in alignment with one of the stamping members and one empty bottle, the stamping member pushes the cotton section out from the holding barrel into the bottle.

With such configuration, the present invention pulls the cotton sections through each roller set and pushes the cotton sections upward into the holding barrel, and controls the rotation device to rotate and deliver the cotton sections, so as to simultaneously press the cotton sections downward into the bottles, achieving a highly efficient stuffing operation of stuffing a plurality of the cotton sections into each bottle at once.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion. Also, to improve readability, some components in certain drawings are omitted, or some drawings are depicted by using imaginary lines.

Figure 6:
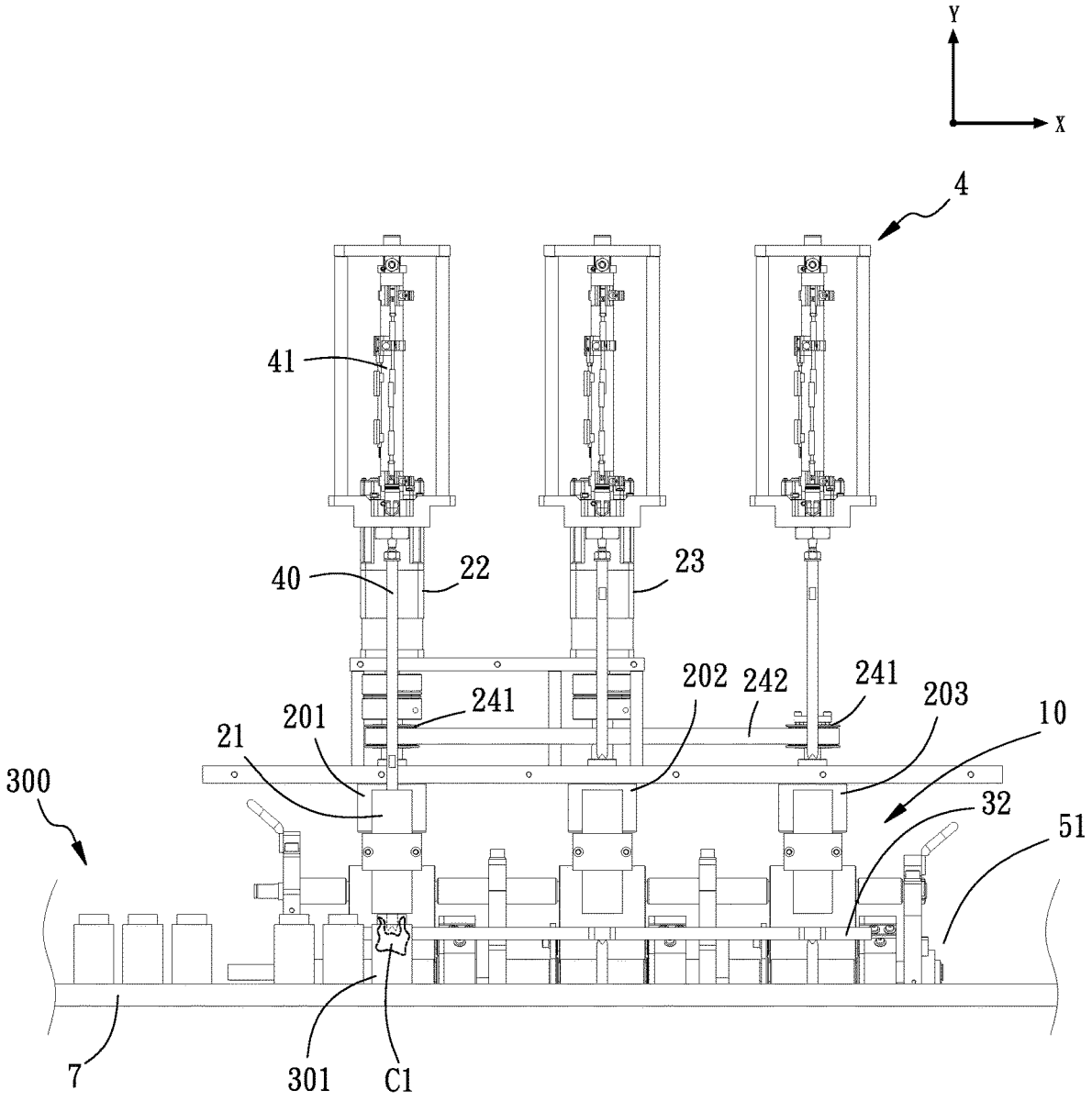
FIG. 6 is a schematic view of the outputting side of the cotton stuffing machine, illustrating the stamping member pushing the cotton section out and stuffing it into the bottle at the first position.

Referring to FIG. 1 to FIG. 8, a cotton stuffing machine 100 is disclosed, comprising a roller conveyance device 1, a rotation device 2, an upward pushing device 3, and a downward pressing device 4. The cotton stuffing machine 100 further comprises a machine body 5 having a feeding side 50 and a stuffing side 51, wherein the roller conveyance device 1 is disposed on the feeding side 50, and the rotation device 2 is disposed on the stuffing side 51. The machine body 5 further comprises a cover for covering the device above (not shown). Therein, as shown by FIG. 6, the present invention applies a programmable conveyor device 7 to input empty bottles 300 in series along an X-axis direction to the stuffing side 51.

Figure 4:
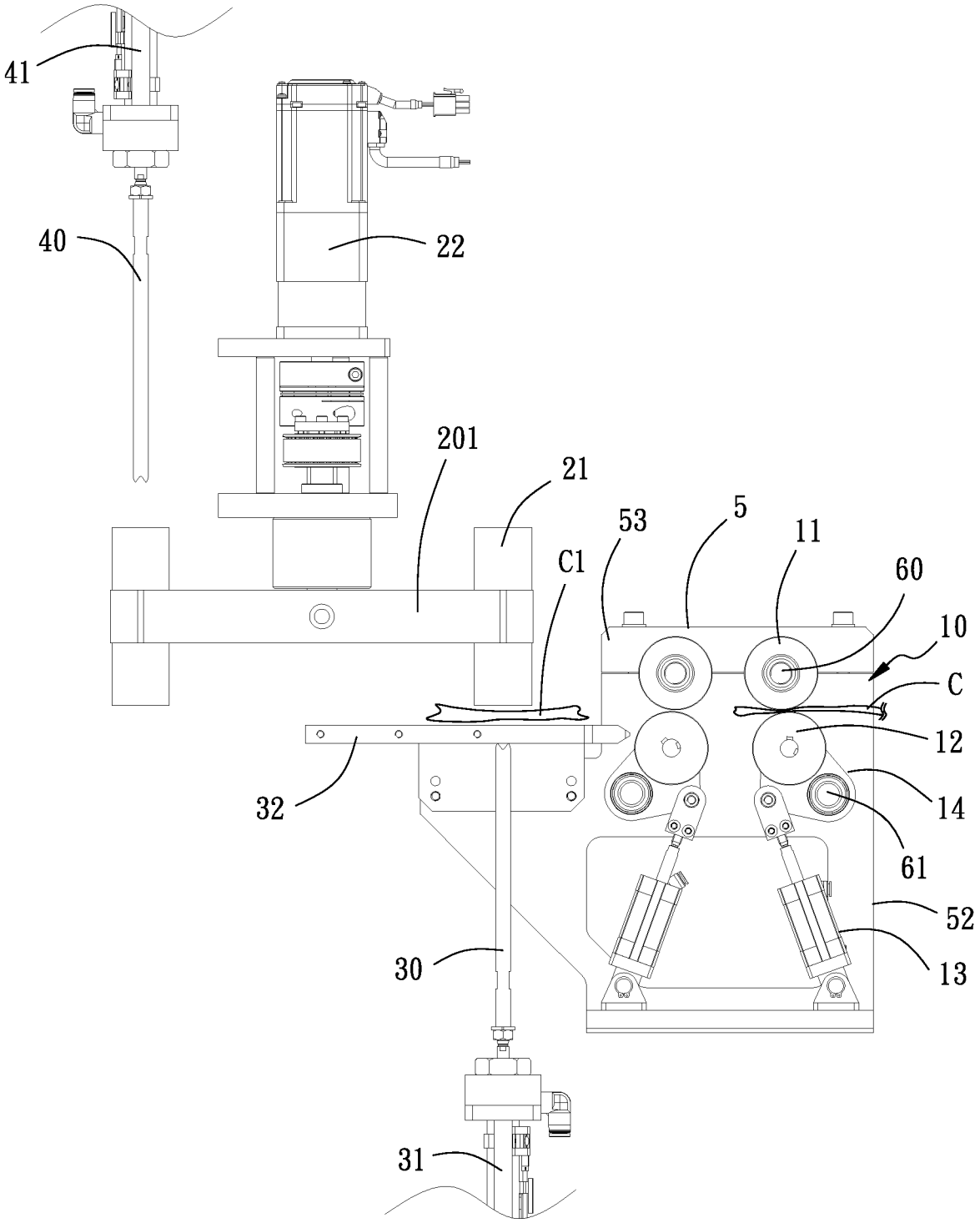
FIG. 4 is a schematic view of the roller set in FIG. 3 pressing and pulling and delivering the cotton section.
Figure 5:
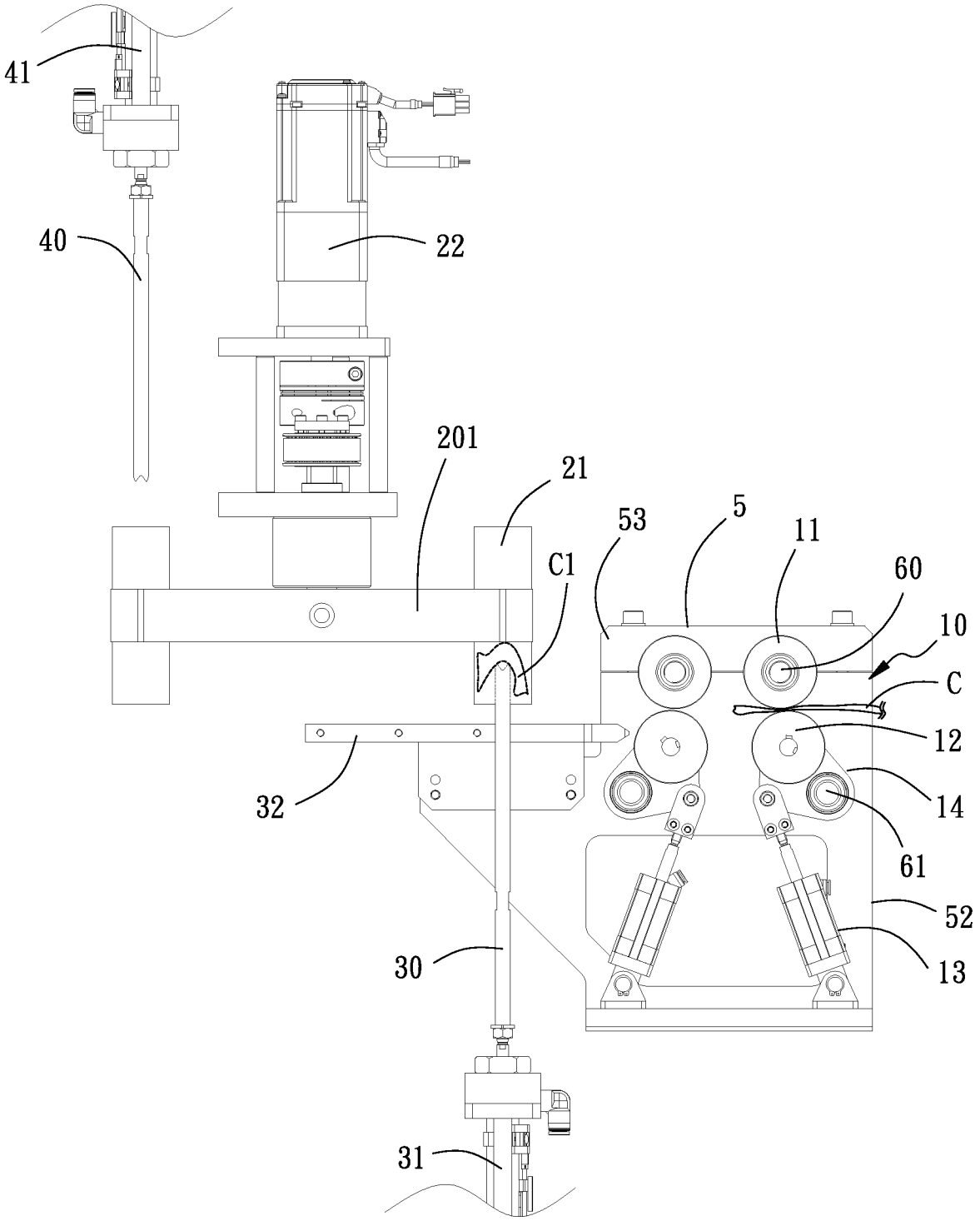
FIG. 5 is a schematic view of the upward pushing device in FIG. 4 pushing the cotton section upward into the holding barrel.

The roller conveyance device 1 comprises a plurality of roller sets 10 arranged in parallel. Each roller set 10 comprises two fix rollers 11 and two neighboring movable rollers 12. The movable rollers 12 are adjustable away from or toward the fix rollers 11, whereby a stripe-shaped cotton C is pressed and pulled to form and deliver a cotton section C1 through the roller set 10, as shown by FIG. 4. Therein, the cotton C is inputted from the feeding side 50 to the roller set 10, such that the cotton C is driven by the fix rollers 11 and the movable rollers 12 to be outputted toward the stuffing side 51. In the embodiment, three roller sets 10 are included, so that the present invention is capable of simultaneously inputting three cottons C to be processed.

Figure 1:
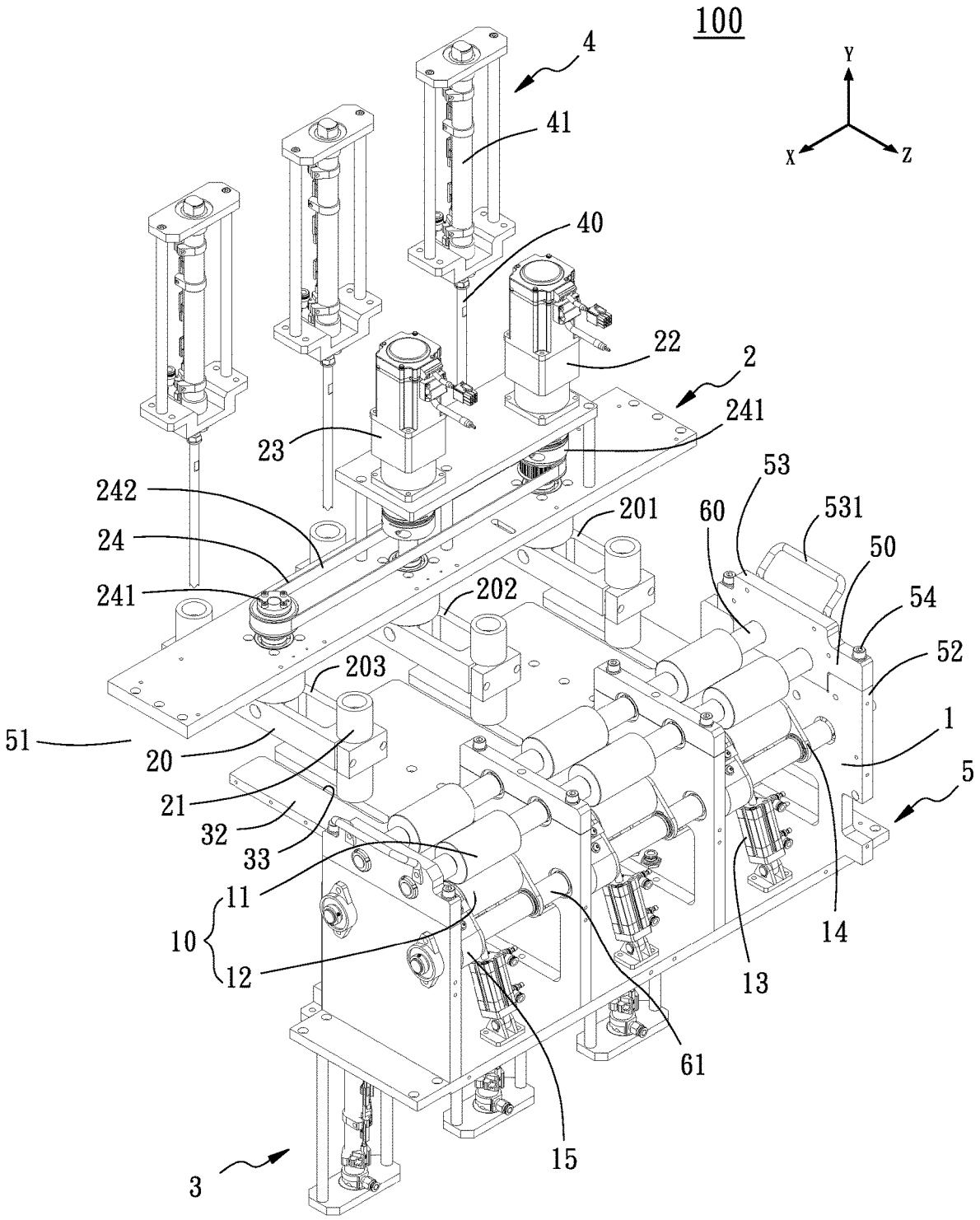
FIG. 1 is a perspective view of the cotton stuffing machine in accordance with an embodiment of the present invention.
Figure 2:
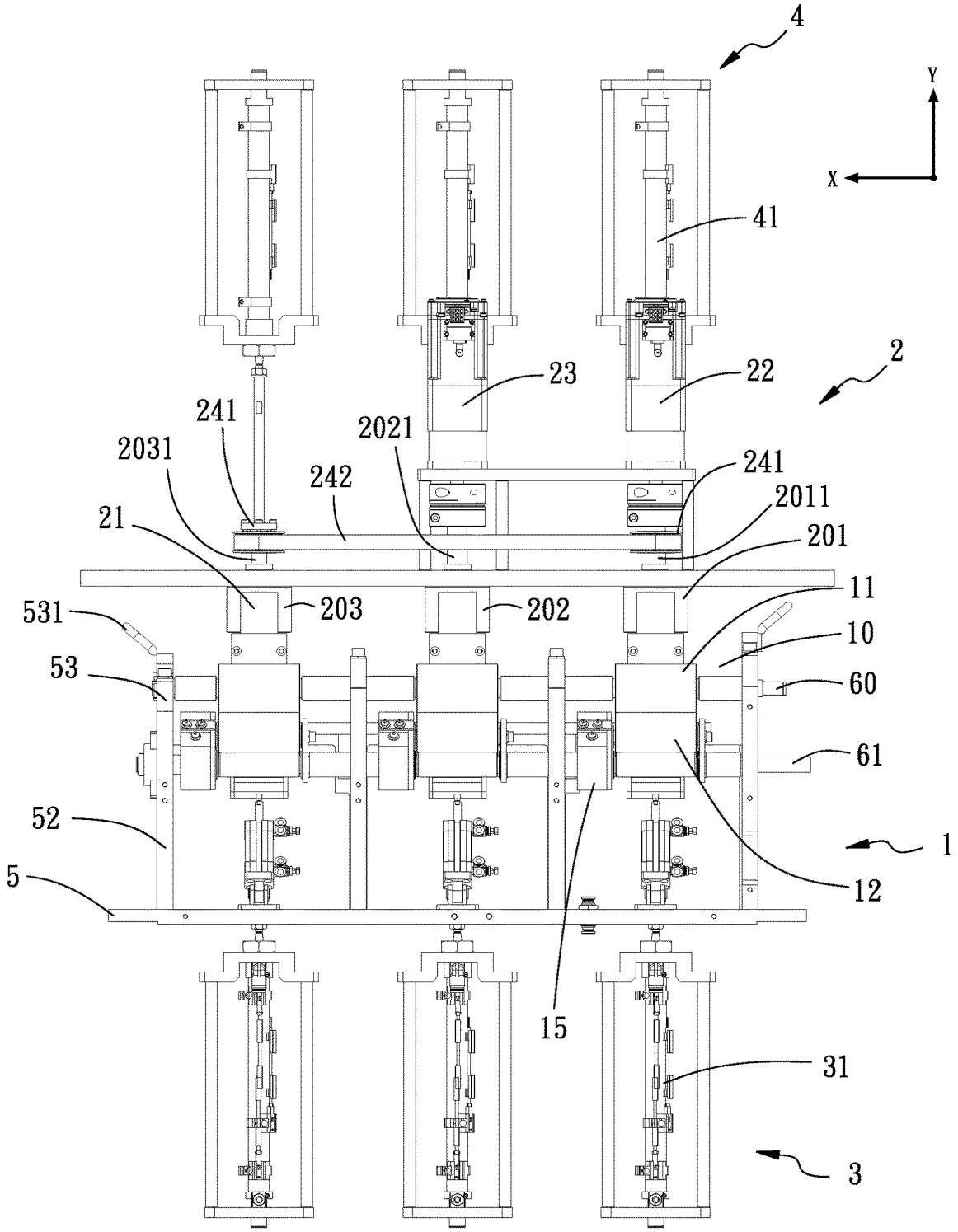
FIG. 2 is a schematic view of the feeding side of the cotton stuffing machine in accordance with an embodiment of the present invention.
Figure 3:
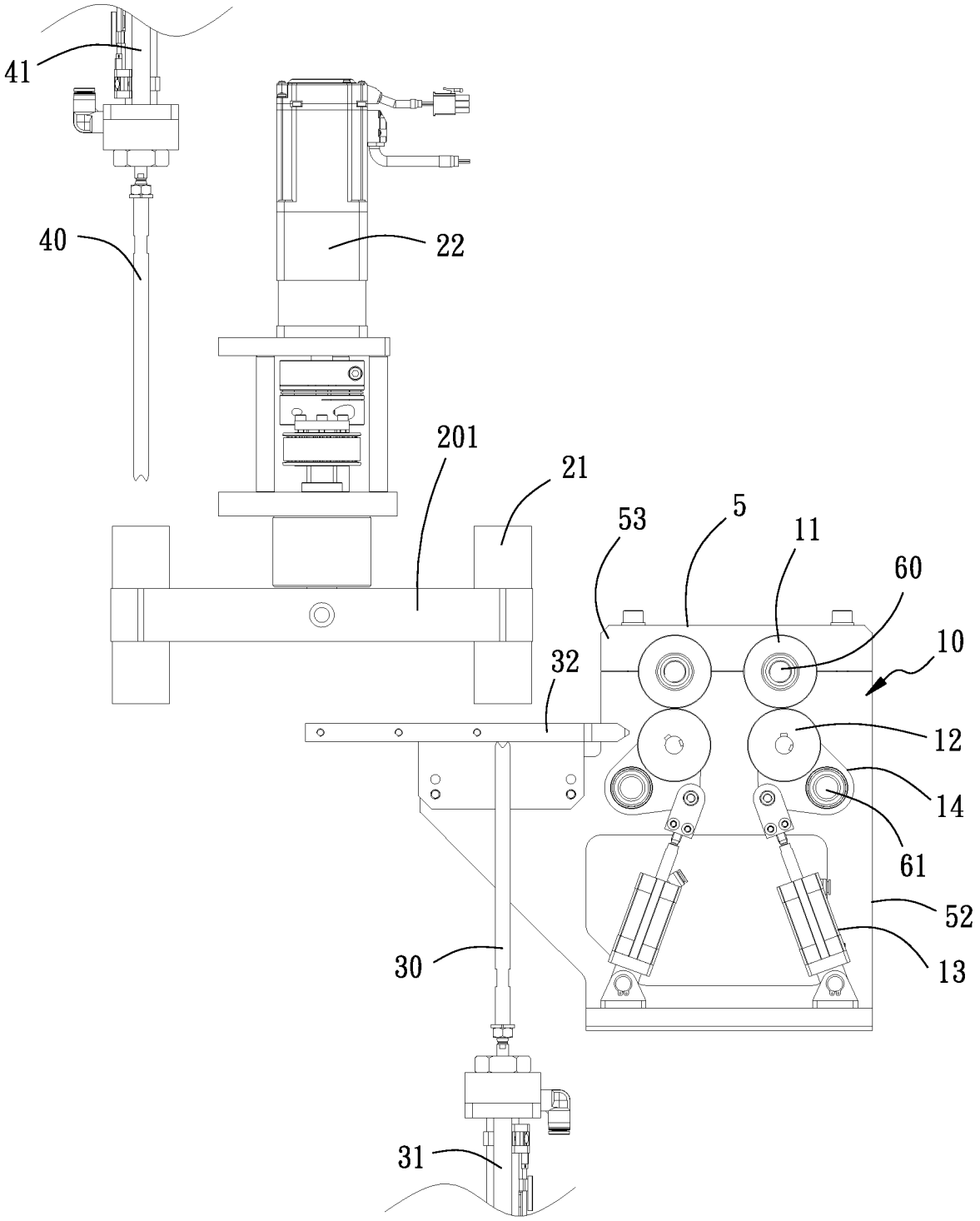
FIG. 3 is a side view of the cotton stuffing machine, illustrating the structural arrangement of the roller set and the rotation arm.

Referring to FIG. 3 and FIG. 4, in the embodiment, each roller set 10 further comprises two stretching members 13 and two connection members 14. The two stretching members 13 are disposed between the two movable rollers 12 and the machine body 5, respectively, for driving the movable rollers 12 to move away from or toward the fix rollers 11. Therein, each stretching member 13 is a pneumatic cylinder disposed in a tilting arrangement. The two connection members 14 are pivotally disposed on the machine body 5 and connected between the two movable rollers 12 and the two stretching members 13, respectively. Therefore, the stretching and retracting of the stretching members 13 drive the connection members 14 to pivot for carrying the movable rollers 12 to move away from or toward the fix rollers 11, thereby adjusting the pressure of the fix rollers 11 and the movable rollers 12 clamping the cotton C. Therefore, when the cotton C enters from the right side in the drawing, the cotton C will be pressed by the fix rollers 11 and the movable rollers 12 on the right side, and pulled and delivered through the fix rollers 11 and the movable rollers 12 on the left side in the form of a cotton section C1.

In the embodiment, the present invention further comprises two upper rotation shafts 60 and two lower rotation shafts 61. The fix rollers 11 are connected with the two upper rotation shafts 60, and the connection members 14 are connected with the two lower rotation shafts 61. The roller set 10 further comprises two gear transmission assemblies 15. The gear transmission assembly 15 is connected between the lower rotation shaft 61 and the movable roller 12. The upper rotation shafts 60 and the lower rotation shafts 61 are driven by a motor (not shown), such that the fix rollers 11 and the movable rollers 12 generate a rotation movement, achieving the function of driving the cotton C and pulling out the cotton section C1.

In another embodiment, the machine body 5 comprises a plurality of stands 52 disposed at intervals and a plurality of position limiting members 53 arranged at the top of the stands 52. Each of the roller sets 10 is disposed between two stands 52. The lower rotation shafts 61 pass through the stands 52, and the upper rotation shafts 60 are arranged at the top of the stands 52 and pass through the position limiting members 53 located on the two lateral sides of the machine body 5. The position limiting members 53 are removably disposed on the stands 52 to limit the upper rotation shafts 60. Therein, a handle 531 is disposed on each position limiting member 53 arranged on the two lateral sides of the machine body 5, respectively. Also, the upper rotation shafts 60 pass through the two position limiting members 53 having the handles 531 thereon. The position limiting members 53 are fastened on the top of the stands 52 through a plurality of bolts 54. Therefore, when the bolts 54 are removed, the user is allowed to lift up the position limiting members 53 using the handles 531, so as to take the fix rollers 11 from the machine body 5, facilitating the cleaning or replacement operation of the fix rollers 11.

The rotation device 2 comprises a plurality of rotation arms 20 corresponding to the roller sets 10. Each rotation arm 20 comprises a hollow holding barrel 21 on two ends thereof, respectively. The rotation arm 20 undergoes a 180-degree rotation displacement between a feeding position and an outputting position. The feeding position is disposed between the roller conveyance device 1 and the rotation device 2. The output position is disposed away from the roller conveyance device 1.

The rotation device 2 comprises a first power source 22, a second power source 23, and a transmission assembly 24. The amount of the rotation arms 20 is identical to the amount of the roller sets 10. The rotation arms 20 comprise a first rotation arm 201, a second rotation arm 202, and a third rotation arm 203, wherein the second rotation arm 202 is between the first rotation arm 201 and the third rotation arm 203. The transmission assembly 24 comprises two pulleys 241 and a belt 242 disposed around the two pulleys 241. The first rotation arm 201 comprises a first shaft 2011 connected with the first power source 22. The second rotation arm 202 comprises a second shaft 2021 connected with the second power source 23. The third rotation arm 203 comprises a third shaft 2031. The two pulleys 241 are axially connected with the first shaft 2011 and the third shaft 2031, respectively. The first power source 22 is configured to drive the first rotation arm 201, and simultaneously drive the third rotation arm 203 through the transmission assembly 24. The second power source 23 is configured to drive the second rotation arm 202. Therein, the rotation time of the first rotation arm 201 is different from the rotation time of the second rotation arm 202, preventing the interference during the stuffing operation.

The upward pushing device 3 is disposed beneath the feeding position. The upward pushing device 3 comprises a plurality of pushing members 30 corresponding to the rotation arms 20 for pushing the cotton section C1 into the holding barrel 21. The upward pushing device 3 comprises a plurality of power cylinders 31 for driving the pushing members 30 to ascend or descend. Also, the upward pushing device 3 further comprises a pushing platform 32 for receiving the cotton section C1 cut by the roller conveyance device 1. The pushing platform 32 comprises a plurality of grooves 33 through which the pushing members 30 pass. When the holding barrel 21 on one end of each rotation arm 20 is at the feeding position in positional alignment with the pushing member 30, the power cylinder 31 drives the pushing member 30 to push upward, so as to push each cotton section C1 into each holding barrel 21. Then, the holding barrel 21 of each rotation arm 20 containing the cotton section C1 rotates and moves to the outputting position, while the empty holding barrel 21 previously at the outputting position rotates to the feeding position for subsequent cotton section C1 filling process.

The downward pressing device 4 is disposed above the outputting position and comprises a plurality of stamping members 40 corresponding to the rotation arm 20, so as to push out the cotton section C1 downward from the holding barrel 21. The downward pressing device 4 comprises a plurality of actuation cylinder 41 for driving the stamping member 40 to ascend or descend. Accordingly, when the holding barrel 21 containing the cotton section C1 rotates from the feeding position to the outputting position, and the holding barrel 21 is in positional alignment with one of the stamping members 40 and one empty bottle 300, the stamping member 40 pushes the cotton section C1 out from the holding barrel 21 and insert it into the corresponding bottle 300, finishing the stuffing process. Therein, the present invention further comprises a sensing device (not shown) for automatically detecting if a bottle 300 is positioned beneath the holding barrel 21. When the bottle 300 is in positional alignment with the holding barrel 21, the stamping member 40 operates; when there is no bottle 300 beneath the holding barrel 21, the stamping member 40 stops operating.

Figure 7:
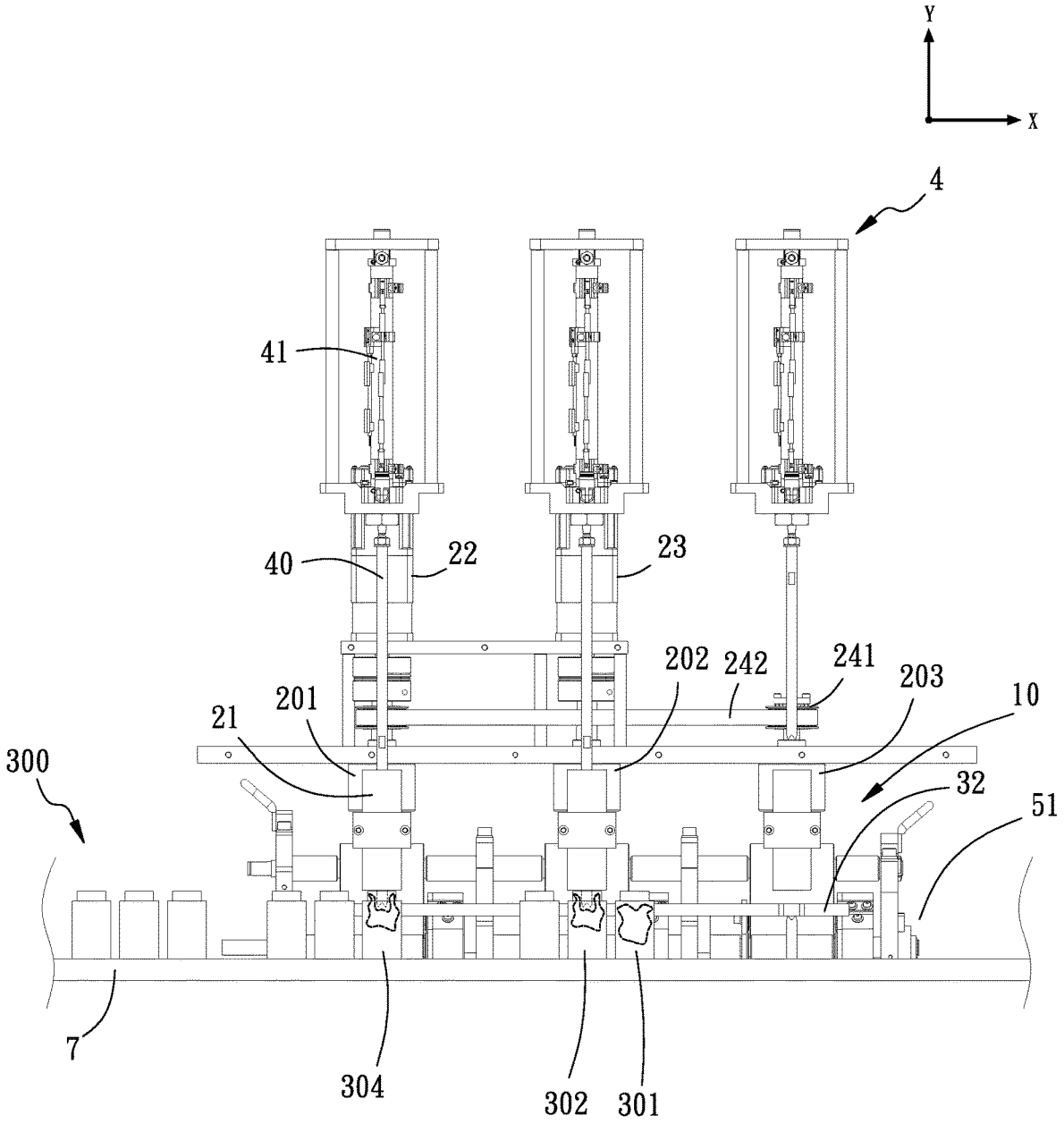
FIG. 7 is a schematic view of the operation in continuation to FIG. 6, illustrating the stamping member pushing out the cotton sections and stuffing them into the bottles at the second and the fourth positions, respectively.
Figure 8:
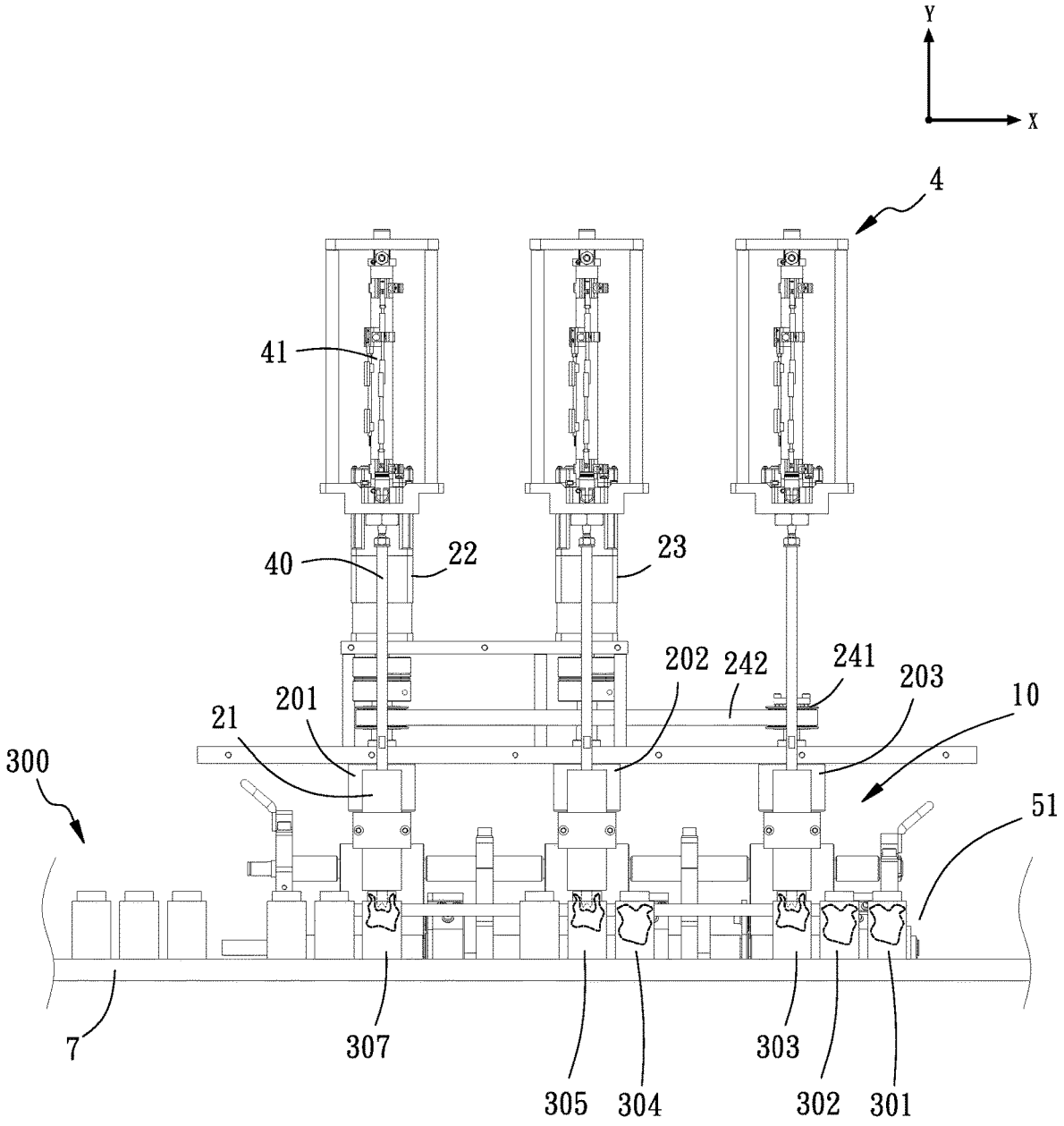
FIG. 8 is a schematic view of the operation in continuation to FIG. 7, illustrating the stamping member pushing out the cotton sections and stuffing them into the bottles at the third, the fifth, and the seventh positions, respectively.

Referring to FIG. 6 to FIG. 8, the cotton stuffing operation of the present invention is further illustrated. As shown by FIG. 6, at the beginning of the operation, the bottles 300 are orderly inputted to the stuffing side 51, so that the bottle 301 at the first position in the drawing is arranged beneath the holding barrel 21 of the first rotation arm 201, allowing the corresponding stamping member 40 to push out the cotton section C1 in the holding barrel 21 of the first rotation arm 201 and insert it into the bottle 301 at the first position.

As shown by FIG. 7, when the bottles 300 keep moving toward the right side in the drawing, the bottle 302 at the second position is arranged beneath the holding barrel 21 of the second rotation arm 202, allowing the stamping member 40 to push out the cotton section C1 in the holding barrel 21 of the second rotation arm 202 and insert it into the bottle 302 at the second position, and the bottle 304 at the fourth position is also arranged beneath the holding barrel 21 of the first rotation arm 201, allowing the stamping member 40 to push out the cotton section C1 in the holding barrel 21 into the bottle 304 at the fourth position.

Then, as shown by FIG. 8, the bottle 303 at the third position moves to the location beneath the holding barrel 21 of the third rotation arm 203, allowing the stamping member 40 to push out the cotton section C1 in the holding barrel 21 thereof and insert it into the bottle 303 at the third position. At the same time, based on the movement method above, the stamping member 40 accordingly pushes out the cotton section C1 in the holding barrel 21 into the bottle 305 at the fifth position, and the stamping member 40 also accordingly pushes out the cotton section C1 in the holding barrel 21 into the bottle 307 at the seventh position. Therefore, the rotation device 2 of the present invention is controlled to orderly rotate the aforementioned three rotation arms 20, and the downward pressing device 4 simultaneously pushes out the cotton sections C1 in each holding barrel 21 and inserts them into the corresponding three bottles 300 beneath.

With the foregoing configuration, the present invention inputs the stripe-shaped cotton C from each roller set 10, respectively, pulls out the cotton sections C1 from each roller set 10, pushes the cotton sections C1 upward into the holding barrels 21, and controls the rotation device 2 to rotate and deliver, so as to simultaneously press the cotton sections C1 downward into each of the bottles 300. Thus, the present invention is capable of achieving a highly efficient operation of stuffing three cotton sections C1 into three bottles 300 at once.

Further, the present invention allows the user to, after removing the bolts 54, lift the position limiting members 53 by use of the handle 531, facilitating the cleaning or replacement operation of the fix rollers 11.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cotton stuffing machine, comprising:

a roller conveyance device comprising a plurality of roller sets disposed in parallel, each of the roller sets comprising two fix rollers and two neighboring movable rollers, the movable rollers being adjustable away from or toward the fix rollers, whereby a cotton is pressed and pulled out to be delivered in a form of a cotton section through the roller sets;

a rotation device comprising a first power source, a second power source, a transmission assembly, and a plurality of rotation arms corresponding to the roller sets, wherein each of the rotation arms has a hollow holding barrel disposed on two ends thereof, the rotation arms undergo a 180-degree rotation displacement between a feeding position and an outputting position, an amount of the rotation arms is identical to an amount of the roller sets, the rotation arms comprise a first rotation arm, a third rotation arm, and a second rotation arm between the first rotation arm and the third rotation arm, the first power source is configured to drive the first rotation arm so as to simultaneously drive the third rotation arm to rotate through the transmission assembly, and the second power source is configured to drive the second rotation arm;

an upward pushing device disposed beneath the feeding position and comprising a plurality of pushing members corresponding to the rotation arms for pushing the cotton section upward into the holding barrel;

a downward pressing device disposed above the outputting position and comprising a plurality of stamping members corresponding to the rotation arms; when the holding barrel containing the cotton section rotates from the feeding position to the outputting position, and the holding barrel is in positional alignment with one of the stamping members and one empty bottle, the stamping member pushes out the cotton section from the holding barrel and inserts the cotton section into the bottle; and a machine body, the machine body comprising a feeding side and a stuffing side, the roller conveyance device disposed on the feeding side, the rotation device disposed on the stuffing side, the feeding position arranged between the roller conveyance device and the rotation device, the outputting position arranged away from the roller conveyance device.

2. The cotton stuffing machine of claim 1, wherein each of the roller sets comprises two stretching members disposed between the two movable rollers and the machine body, respectively, for driving the movable rollers to move away from or toward the fix rollers.

3. The cotton stuffing machine of claim 2, wherein each of the roller sets further comprises two connection members pivotally disposed on the machine body, respectively, and connected between the two movable rollers and the two stretching members.

4. The cotton stuffing machine of claim 3, wherein the two stretching members are both a pneumatic cylinder disposed in a tilting arrangement.

5. The cotton stuffing machine of claim 3, further comprising two upper rotation shafts and two lower rotation shafts, the fix rollers being axially connected with the two upper rotation shafts, the connection members being axially connected with the two lower rotation shafts, each of the roller sets comprising two gear transmission assemblies connected between the lower rotation shafts and the movable rollers.

6. The cotton stuffing machine of claim 1, wherein the transmission assembly comprises two pulleys and a belt disposed around the two pulleys; the first rotation arm comprises a first shaft connected with the first power source; the second rotation arm comprises a second shaft connected with the second power source; the third rotation arm comprises a third shaft; the two pulleys are axially connected with the first shaft and the third shaft, respectively.

7. The cotton stuffing machine of claim 1, wherein a plurality of the bottles are inputted to the stuffing side in series along an X-axis direction; a rotation time of the first rotation arm is different from a rotation time of the second rotation arm.

8. A cotton stuffing machine, comprising:

a roller conveyance device comprising a plurality of roller sets disposed in parallel, each of the roller sets comprising two fix rollers and two neighboring movable rollers, the movable rollers being adjustable away from or toward the fix rollers, whereby a cotton is pressed and pulled out to be delivered in a form of a cotton section through the roller sets;

a rotation device comprising a plurality of rotation arms corresponding to the roller sets, each of the rotation arms having a hollow holding barrel disposed on two ends thereof, the rotation arms undergo a 180-degree rotation displacement between a feeding position and an outputting position;

an upward pushing device disposed beneath the feeding position and comprising a plurality of pushing members corresponding to the rotation arms for pushing the cotton section upward into the holding barrel; and a downward pressing device disposed above the outputting position and comprising a plurality of stamping members corresponding to the rotation arms; when the holding barrel containing the cotton section rotates from the feeding position to the outputting position, and the holding barrel is in positional alignment with one of the stamping members and one empty bottle, the stamping member pushes out the cotton section from the holding barrel and inserts the cotton section into the bottle;

a machine body, the machine body comprising a feeding side and a stuffing side, the roller conveyance device disposed on the feeding side, the rotation device disposed on the stuffing side, the feeding position arranged between the roller conveyance device and the rotation device, the outputting position arranged away from the roller conveyance device; and two upper rotation shafts and two lower rotation shafts, the fix rollers being axially connected with the two upper rotation shafts, the connection members being axially connected with the two lower rotation shafts, each of the roller sets comprising two gear transmission assemblies connected between the lower rotation shafts and the movable rollers; and wherein each of the roller sets comprises two stretching members disposed between the two movable rollers and the machine body, respectively, for driving the movable rollers to move away from or toward the fix rollers;

wherein each of the roller sets further comprises two connection members pivotally disposed on the machine body, respectively, and connected between the two movable rollers and the two stretching members; and wherein the machine body further comprises a plurality of stands disposed at intervals and a plurality of position limiting members arranged at the top of the stands; each of the roller sets is disposed between two of the stands; the lower rotation shafts pass through the stands, the upper rotation shafts are arranged at the top of the stands and pass through the position limiting members located on the two lateral sides of the machine body; and the position limiting members are removably disposed on the stands for limiting the upper rotation shafts.

* * * * *